US008152328B2

(12) United States Patent
Parini et al.

(10) Patent No.: US 8,152,328 B2
(45) Date of Patent: Apr. 10, 2012

(54) VERSATILE AND COMPACT PORTABLE LIGHTING DEVICE

(75) Inventors: Philippe Parini, Paray Vieille Poste (FR); Philippe Praudel, Longjumeau (FR); Jocelyn Vecchio, Vitry sur Seine (FR)

(73) Assignee: Stanley Works (Europe) GmbH, Dubendorf (CH)

( * ) Notice: Subject to any disclaimer, the term of this patent is extended or adjusted under 35 U.S.C. 154(b) by 143 days.

(21) Appl. No.: 12/595,300

(22) PCT Filed: Apr. 3, 2008

(86) PCT No.: PCT/FR2008/050590

§ 371 (c)(1),
(2), (4) Date: Feb. 23, 2010

(87) PCT Pub. No.: WO2008/145880

PCT Pub. Date: Dec. 4, 2008

(65) Prior Publication Data

US 2010/0149795 A1 Jun. 17, 2010

(30) Foreign Application Priority Data

Apr. 12, 2007 (FR) ..... 07 54419

(51) Int. Cl.
*F21L 4/04* (2006.01)

(52) U.S. Cl. ..... 362/198; 362/190; 362/191; 362/200

(58) Field of Classification Search ..... 362/188, 362/190, 191, 287, 427, 98, 99, 198, 199
See application file for complete search history.

(56) References Cited

U.S. PATENT DOCUMENTS

| | | | | |
|---|---|---|---|---|
| 5,944,407 | A | 8/1999 | Lynch et al. | |
| 6,361,184 | B1 * | 3/2002 | Hallgrimsson et al. | 362/188 |
| 6,808,289 | B2 * | 10/2004 | Reed | 362/198 |
| 7,311,418 | B2 * | 12/2007 | Zeller et al. | 362/198 |
| 7,705,542 | B2 * | 4/2010 | Hilt et al. | 315/185 S |
| 2006/0109662 | A1 | 5/2006 | Reiff et al. | |

OTHER PUBLICATIONS

International Search Report issued Oct. 31, 2008 in International (PCT) Application No. PCT/FR2008/050590.

* cited by examiner

*Primary Examiner* — Ali Alavi
(74) *Attorney, Agent, or Firm* — Wenderoth, Lind & Ponack, L.L.P.

(57) ABSTRACT

The invention relates to a lighting device including a power supply housing, a lighting head including at least one light source, and a connection arm having an elongated shape. The arm includes a first end connected to the housing and a second end connected to the head in order to mechanically connect the housing and the head, the latter being mobile relative to the housing between a first position in which the head is in the vicinity of and/or connected to the power supply housing, and at least a second position in which the head is remote and/or disconnected from the housing. The length of the arm is shorter than or equal to the largest dimension of the power supply housing.

20 Claims, 6 Drawing Sheets

VERSATILE AND COMPACT PORTABLE LIGHTING DEVICE

BACKGROUND OF THE INVENTION

1. The Present Invention

The present invention relates to a portable lighting device comprising a power supply housing; a lighting head having at least one light source; a linking arm having an elongate shape; the arm having a first end which is connected to the supply housing and a second end which is connected to the lighting head in order mechanically to link the supply housing and the lighting head, the lighting head being movable relative to the supply housing between a first position, in which the lighting head is close to and/or integral with the supply housing, and at least one second position, in which the lighting head is remote from and/or not integral with the supply housing.

2. State of the Prior Art

It is known from patent EP-B1-0 528 501 to use a flashlight comprising a power supply housing, an elongate extension, of which one end is connected to the housing and the other carries a lighting head, and energy transfer means carried by the extension and designed to connect the power supply housing to the lighting head. The extension can easily be flexed by hand and is able to retain a given shape indefinitely, so that the power supply housing and the lighting head can each be positioned and oriented independently of one another. The housing comprises a peripheral groove on which the extension is wound in order to obtain compact storage. A holding member integral with the housing allows the lighting head to be held in the immediate vicinity of and integral with the supply housing.

However, that flashlight is not suitable for use in confined spaces such as, for example, a motor vehicle engine or a substructure of such a motor vehicle. A flashlight according to the prior art does not have either compactness or stability for effective use in the most difficult places to access.

SUMMARY OF THE INVENTION

The technical problem to be solved is that of improving the versatility of the portable lighting device in order to allow it to be used in various configurations while ensuring that the lighting device is compact and stable.

To that end, the invention relates to a portable lighting device of the above-mentioned type, characterised in that the length of the arm is less than or equal to the largest dimension of the supply housing.

According to other features:

- the first end of the arm is articulated relative to the supply housing according to a first axis of rotation (Y-Y);
- the second end of the arm is articulated relative to the lighting head according to a second axis of rotation (Z'-Z');
- the second axis of rotation (Z'-Z') is substantially perpendicular to the first axis of rotation (Y-Y);
- at least one of the ends of the arm is articulated solely for rotation about the respective axis of rotation (Y-Y, Z'-Z');
- the arm is rigid;
- the arm is flexible, in particular can be manipulated by hand and is able to retain a given shape indefinitely;
- the housing comprises a recess suitable for accommodating at least part of the lighting head when the lighting head is in the first position;
- the housing further comprises a groove which extends according to a longitudinal axis (Z-Z) centered in the median plane (IV-IV) of the housing and which is suitable for accommodating at least part of the arm when the lighting head is arranged in said first position relative to the supply housing;
- the housing (12) has a generally parallelepipedal shape suitable for defining a stable base which is to be placed on an outside surface.

According to another aspect, the object of the invention is to improve the mounting of the lighting head. That problem is solved in that, in a portable lighting device of the type mentioned above, the lighting head comprises a protective cover, a body and an optical element, the latter being mounted at a distance from the light source and in abutment on support means integral with the body under the force of resilient means integral with the cover.

BRIEF DESCRIPTION OF THE DRAWINGS

The invention and its advantages will be better understood upon reading the description which follows, which is given solely by way of example and with reference to the accompanying figures, in which.

DETAILED DESCRIPTION OF THE PREFERRED EMBODIMENT

Figure 1:
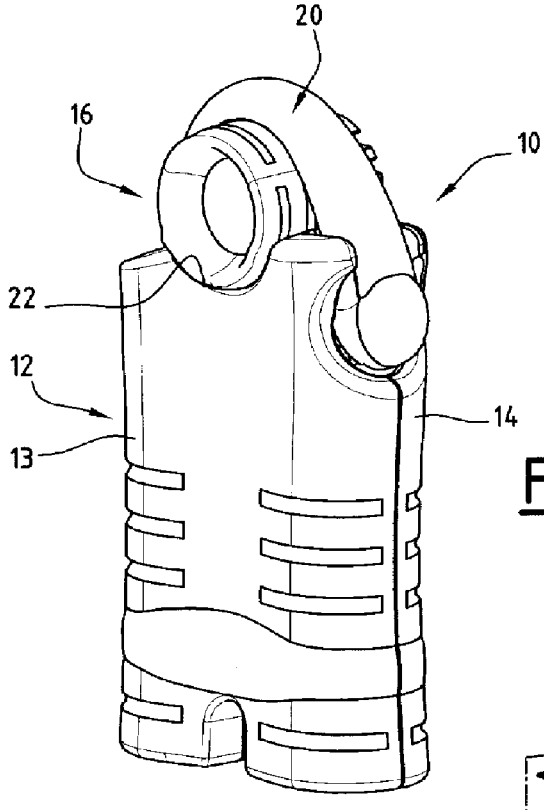
FIG. 1 is a perspective view of a front face of the portable lighting device according to the invention.
Figure 2:
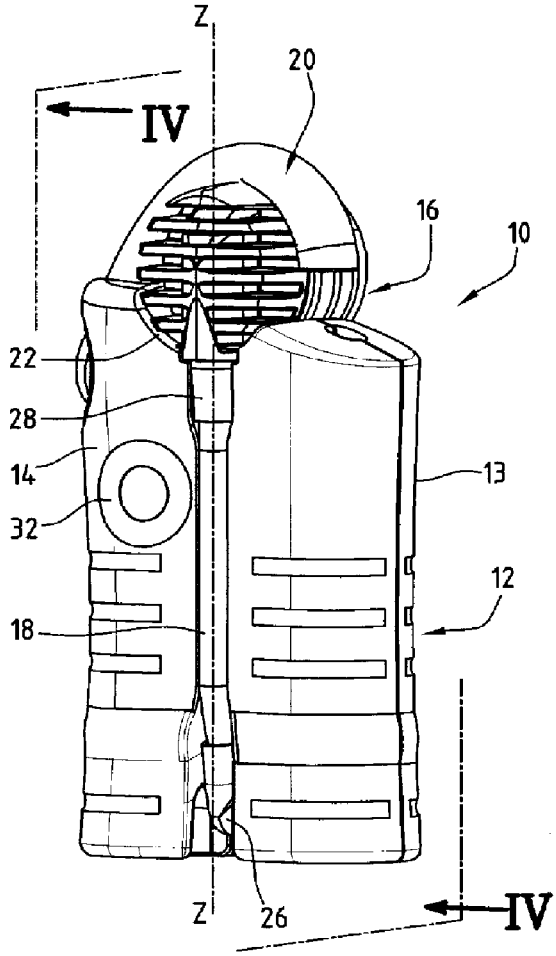
FIG. 2 is a perspective view of a rear face of the portable lighting device according to the invention.

FIGS. 1 and 2 show a portable lighting device 10 comprising a power supply housing 12 of generally parallelepipedal shape. A front shell 13 and a rear shell 14 delimit the supply housing 12.

The portable lighting device also comprises a lighting head 16 which is rotatably mounted at one end of an arm 18 (FIG. 2). The latter is itself mounted to be rotatable relative to the supply housing 12 and links the supply housing 12 to the lighting head 16.

A holding member 20 retains the lighting head 16 in a recess 22 which has a shape substantially complementary to that of the lighting head and is provided in the supply housing 12.

The arm 18 has a first end 24 which is connected to the supply housing by a bent connecting piece 26, and a second end 27 which is connected to the lighting head by a straight connecting piece 28. The linking arm 18 is made of a flexible material which can be manipulated by hand and is able to retain a given shape indefinitely. By way of variation, it is made of a rigid material. The arm 18 is hollow so that electrical conductors (not shown) for transferring energy from the power supply housing 12 to a light source 30 (FIG. 3) arranged in the lighting head 16 are able to pass through on the inside.

A button 32 (FIG. 2) is provided on the rear shell 14 in order to illuminate and extinguish the device 10.

Figure 3:
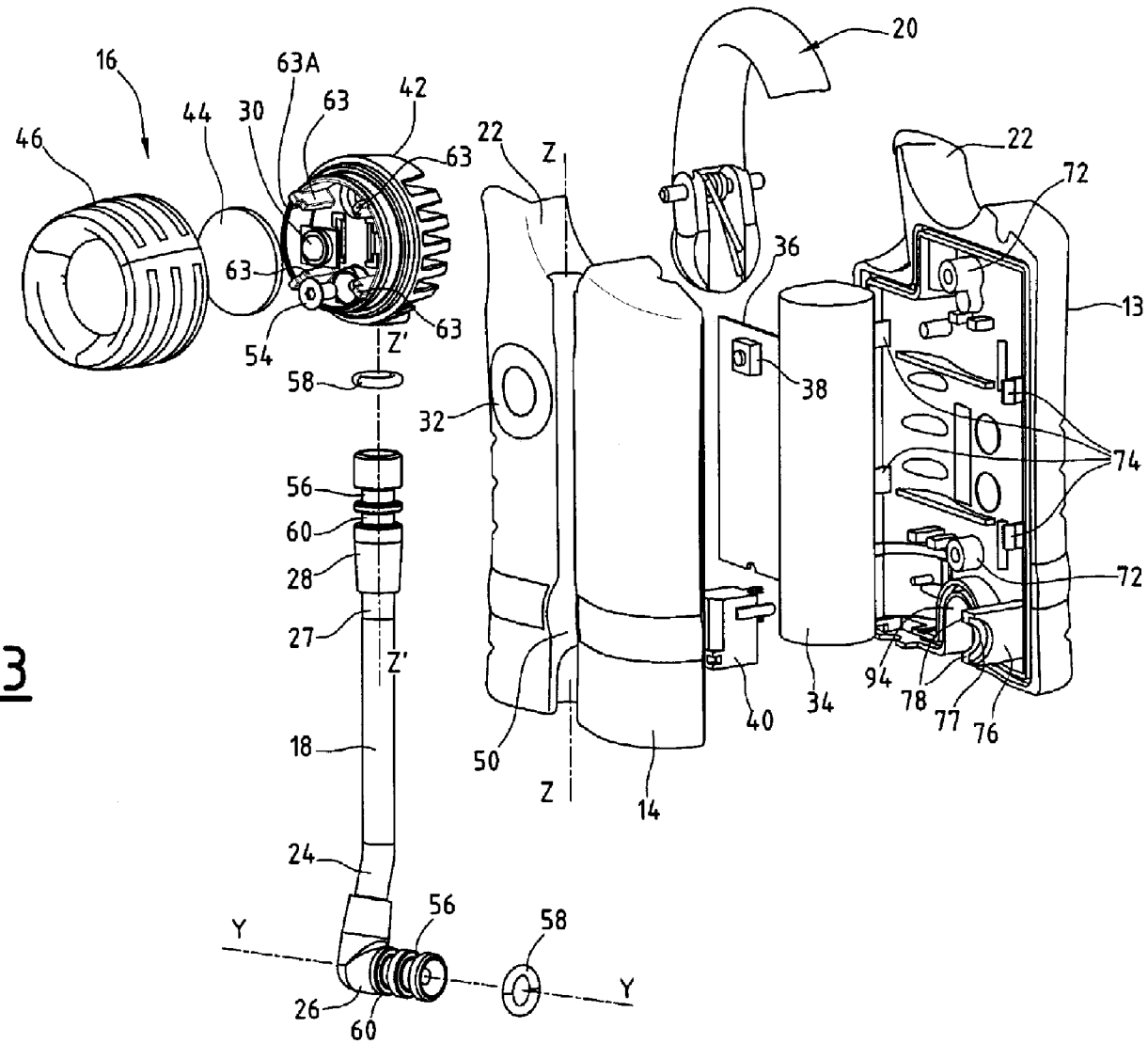
FIG. 3 is an exploded perspective view of the portable lighting device according to the invention.

As is shown in FIG. 3, the front and rear shells 13 and 14 are hollow and, once fitted together, define an inside space envelope which forms the supply housing 12. The inside space envelope contains at least one cell or battery 34, in particular a battery of the rechargeable type, and an electric circuit board 36 on which there is mounted at least one switch 38 with which the device 10 can be turned on and off. The inside space envelope is also adapted to receive a connector 40 allowing the rechargeable battery 34 to be recharged.

Accordingly, the supply housing 12 equipped with its electronics and its battery has, in a compact space, a weight that is very much greater than that of the other components of the lighting device 10.

In addition to the light source 30 in the form of at least one high-power light-emitting diode, the lighting head 16 has a body 42 on which the or each diode is mounted. The body 42 is intended to dissipate, by conduction, the heat emitted by the diode. A collimating lens 44 is arranged in front of the light-emitting diode 30 in the light propagation direction. A cover 46, made of elastomeric material, for protecting the lighting head 16 is fixed to the body 42 and holds the lens 44 in place, as will be described hereinbelow.

Figure 4:
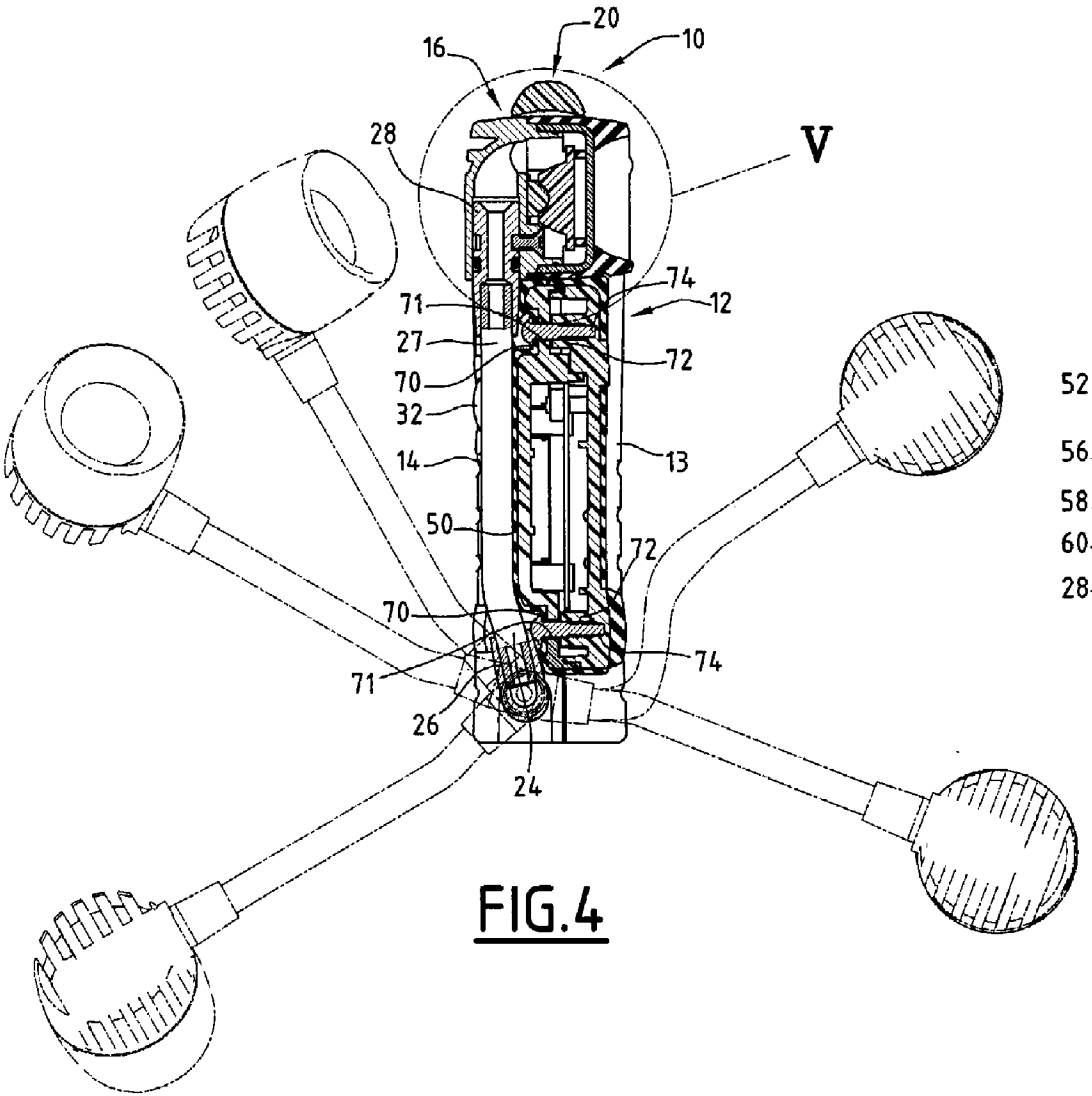
FIG. 4 is a cutaway view according to a median plane IV-IV of FIG. 2.

The lighting head 16 is movable relative to the supply housing 12 between:

- a first position, in which the lighting head is in the immediate vicinity of or integral with the supply housing 12, as is shown in FIGS. 1, 2 and 4 by solid lines, and
- at least one second position, in which the lighting head 16 is remote from or not integral with the supply housing 12, as is shown by dot-and-dash lines in FIG. 4.

To that end, the arm 18 is pivotably articulated relative to the supply housing 12 in the region of the bent connecting piece 26 according to a first axis of rotation Y-Y (FIG. 3).

Also to that end, the lighting head 16 is pivotably articulated relative to the arm 18 in the region of the straight connecting piece 28 according to a second axis of rotation Z'-Z', which is substantially perpendicular to the first axis of rotation Y-Y when the arm is substantially straight.

The angle of rotation about the first axis of rotation Y-Y and the angle of rotation about the second axis of rotation Z'-Z' are substantially greater than or equal to 270°.

The rear shell 14 has a longitudinal groove 50 which is arranged substantially in the median plane IV-IV (FIG. 2) of the housing 12 and extends according to a longitudinal axis Z-Z (FIGS. 2 and 3), which axis is substantially perpendicular to the axis of rotation Y-Y of the bent connecting piece 26. The groove 50 is suitable for receiving at least part of the arm 18 and the connecting pieces 26 and 28 when the working head 16 is in the first position relative to the supply housing 12. Accordingly, at least part of the arm 18 is accommodated in the groove 50.

The length of the arm 18 is less than or equal to the largest dimension of the supply housing 12. Such a dimension of the arm 18, combined with the degree of freedom of the lighting head 16 relative to the arm 18, and of the arm 18 relative to the supply housing 12, allows the portable lighting device according to the invention to have improved characteristics of compactness and use.

The size of the arm 18 means that the position of the center of gravity of the device can be kept close to that of the housing, whatever the position of the lighting head 16, and the stability of the lighting device 10 can thus be improved.

Figure 5:
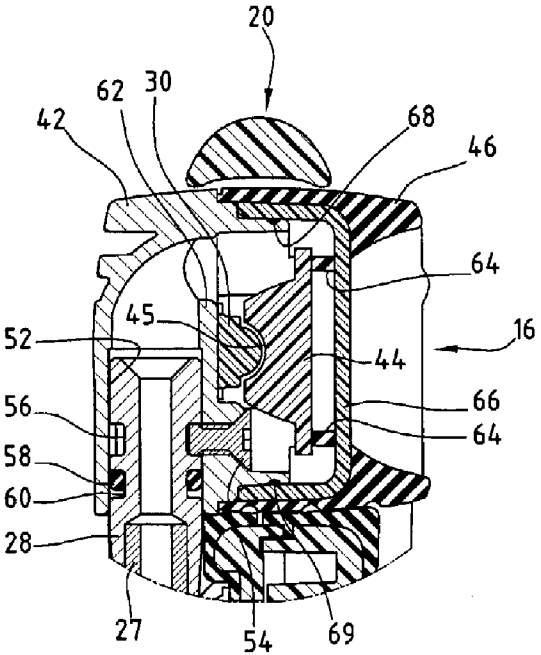
FIG. 5 is an enlarged view of detail V of FIG. 4.

As shown in FIG. 5, the heat-dissipating body 42 of the lighting head 16 is made of a lightweight, heat-conducting alloy, for example aluminium alloy. It has a bore 52 of circular transverse cross-section in its rear and bottom portion, in which the straight connecting piece 28 is mounted by a form fit.

A fixing element 54, such as a screw integral with the body 42, engages in a circular groove 56 provided on the outer periphery of the straight connecting piece 28.

Accordingly, while ensuring the degree of freedom of rotation of the lighting head 16 relative to the arm 18 about the axis Z'-Z', the fixing element 54 stops any axial movement of the lighting head 16 relative to the arm 18 according to the axis Z'-Z'.

A braking element 58, such as an O-ring, mounted in a circular groove 60 provided on the outer periphery of the straight connecting piece 28 allows the rotary movement of the lighting head 16 relative to the arm 18 to be braked.

The high-power light-emitting diode 30, which is of hemispherical shape, is fixed by a suitable means, such as adhesive bonding, to a suitable support 62 of peripheral form integral with the heat-dissipating body 42.

The collimating lens 44, which is of circular shape, has a hemispherical recess 45 which receives the diode 30 with play in all directions. The lens additionally abuts columns 63 (FIG. 3) integral with the body 42. Each column has a shoulder 63A for centering of the lens. Resilient protuberances 64 are integral with the elastomeric cover 46. They project in the direction towards the lens 44 from a protective plate 66 made of transparent or translucent plastics material, over which the protective cover 46 is moulded. The shape and dimensions of the protuberances 64 are such that they hold the lens 44 in its position resting on the columns 63 owing to slight compression of the elastomeric material. Fitting of the assembly constituted by the cover 46 and the plate 66 to the body 42 is effected by resilient interlocking. To that end, a circular rib 68 integral with the plate 66 engages with a complementary groove 69 integral with the body 42.

When the lighting head 16 is mounted, the resilient protuberances 64 are compressed slightly in order to take up the functional play and enable the lens 44 to be held in a stable position in the head 16 without additional fixing. Mounting is thus simple. Impacts transmitted from the cover 46 to the light source are attenuated by the presence of the elastomeric protuberances and by the play between the diode 30 and the recess 45 in the lens.

In the device according to the invention, the materials used to produce the lighting head 16, the arm 18 and the connecting pieces 26 and 28 are such that the weight of the assembly is very much lower than that of the supply housing 12 equipped with its electronics and its battery.

Accordingly, with the housing 12 serving as a base to be placed on a support surface, the lighting device 10 is kept stable while permitting orientation of the lighting head 16 according to at least two degrees of freedom.

As is shown in FIG. 4, in which the intermediate portion of the arm 18 has been cut away for the purpose of clarity of the drawings, the rear shell 14 has, at the bottom of a longitudinal groove 50, two receivers 70 which are axially remote from one another and are equipped with a through-bore 71.

The shell 13 has, on the inside, two projections 72 which are axially remote from one another and are each equipped with a blind bore. Once the front and rear shells 13 and 14 have been fitted together, each receiver 70 is located opposite a projection 72. Screws 74 are provided for fixing the shells 13 and 14 to one another, the screw head resting in the receivers 70 while the threaded portion is screwed into the projection 72.

Resilient lugs 74 (FIG. 3) are arranged on the front shell 13 in the region of the interface with the rear shell 14 in order to complete the fixing of the shells 13 and 14 at the periphery of the housing 12 by a snap fit.

Figure 6:
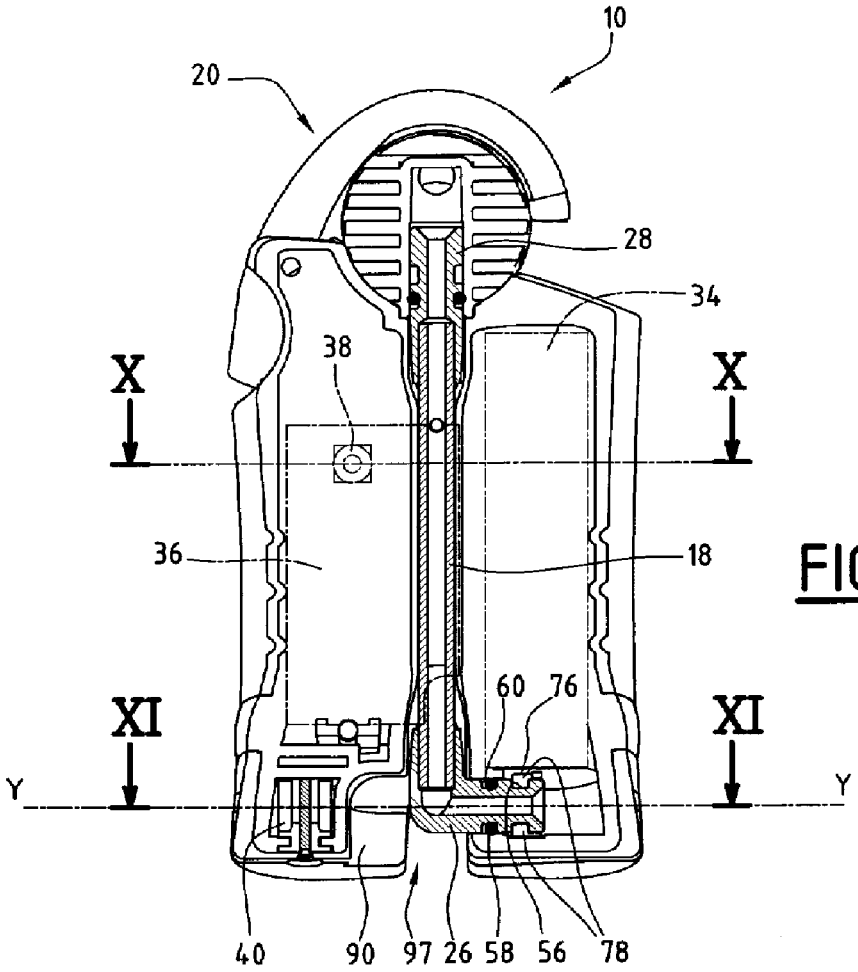
FIG. 6 is a rear view, partially cut away, of the portable lighting device according to the invention.

As is shown in FIGS. 3 and 6, the interior part of the front shell 13 comprises a positioning lug 76 equipped with a concave circular rib 77 defining two ends 78.

When the bent connecting piece 26 is fitted onto the positioning lug 76, the circular groove 56 of the bent connecting piece 26 engages with the rib 77 of the lug 76 in order to stop any axial movement of the bent connecting piece 26 according to the axis Y-Y while permitting a degree of freedom about that axis of rotation Y-Y.

As above for the straight connecting piece 28, the bent connecting piece 26 has a second groove 60 in which there is arranged an O-ring 58, the purpose of which is to brake the rotary movement of the arm 18 by friction against an inside surface of the housing 12.

Figure 10:
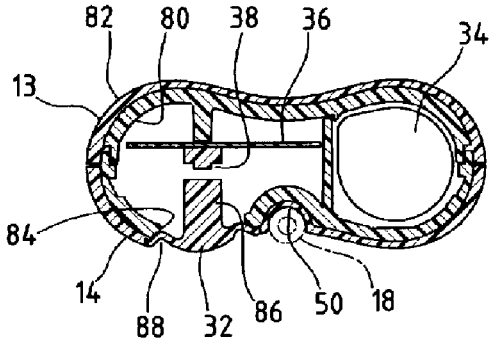
FIG. 10 is a view in transverse section according to line X-X of FIG. 6.
Figure 11:
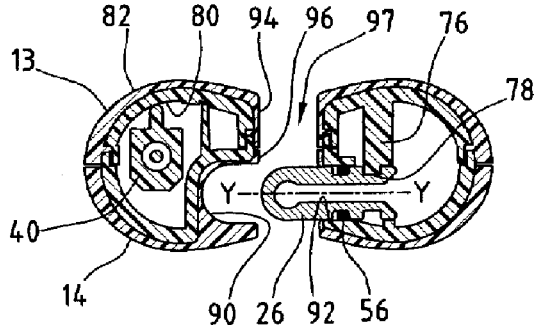
FIG. 11 is a view in transverse section according to line XI-XI of FIG. 6.

As is shown in FIGS. 10 and 11, the housing 12 has a transverse cross-section of oblong shape equipped with a central narrow portion comprising the groove 50. The arm 18, once it has been accommodated at least partially in the groove 50, is contained in the outside space envelope of the housing 12. The shape of the transverse cross-section accordingly improves both the compactness and the stability of the device 10.

The shells 13 and 14 are preferably made of coated plastics material. Accordingly, each shell comprises a rigid inside part 80 over which there is moulded, externally, a flexible part 82 made of elastomer.

The on/off button 32 is advantageously derived from the overmoulded part 82 of flexible elastomeric material in order to improve the tightness of the portable lighting device. In the region of the button 32 (FIG. 10), the rigid part of the rear shell has an opening 84 in which there engages, internally, a protuberance 86 of the overmoulded part 82 which is to actuate the switch 38 arranged on an electric circuit board 36. The travel of the button 32 is defined by the deformation of the membrane 88 connecting the periphery of the button 32 to the remainder of the elastomeric part 82 of the rear shell 14.

The rear shell 14 has at its base an internal lateral passage 90. This allows the bent connecting piece 26 to be inserted into an opening 92 provided opposite the passage 90.

The portion of the bent connecting piece 26 that extends according to the first axis of rotation Y-Y is accordingly disposed in the space envelope of the housing 12. That portion of the bent connecting piece 26 does not have an element projecting from the housing 12, which improves the compactness of the portable lighting device 10.

The front and rear shells 13 and 14 comprise passages 94 and 96, respectively, which open at the respective front and rear faces of the housing 12 and as a continuation of one another when the shells are fitted together. In that manner, a recess 97 is freed for the passage of the arm 18 and of the bent connecting piece 26 on rotation thereof about the first axis of rotation Y-Y.

Figure 8:
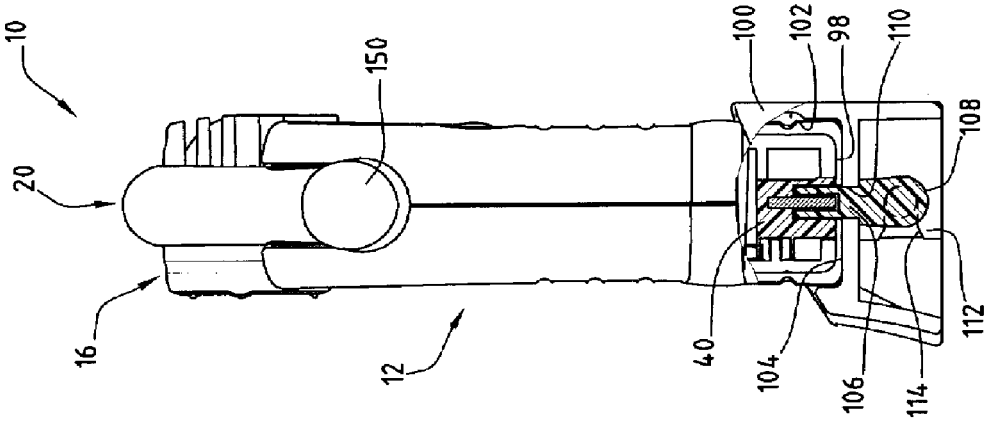
FIG. 8 is a side view of the portable lighting device according to the invention mounted on the charging base.
Figure 7:
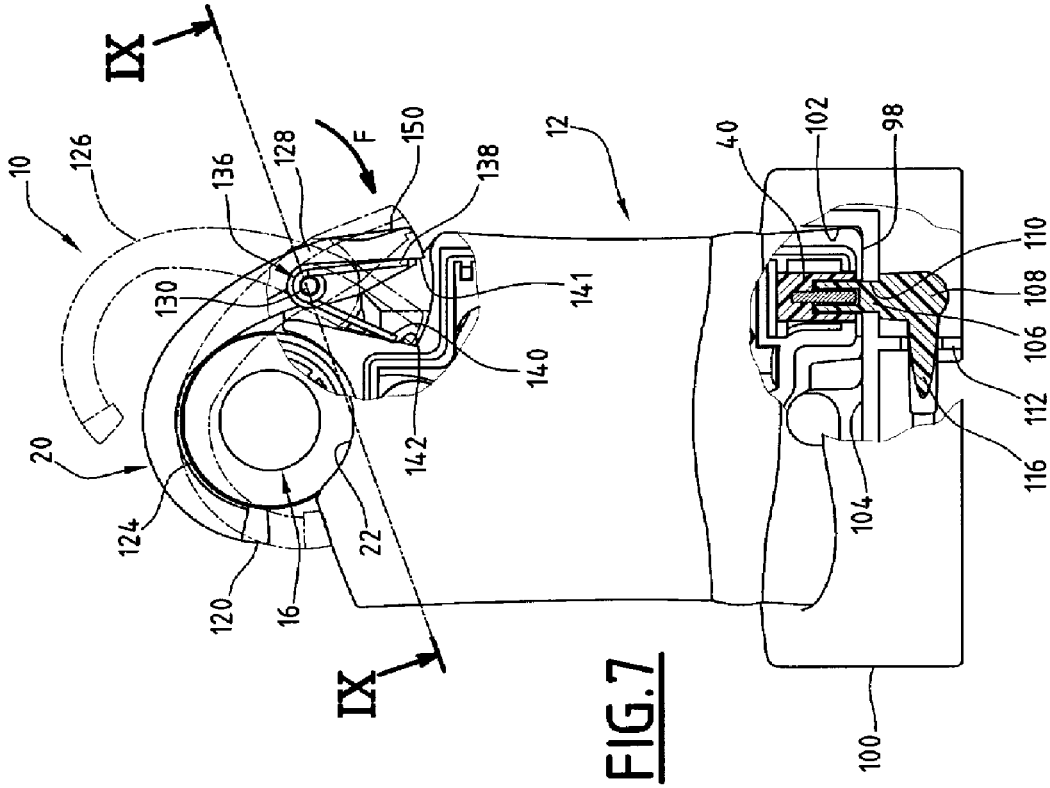
FIG. 7 is a front view of the portable lighting device according to the invention mounted on a charging base.
Figure 12:
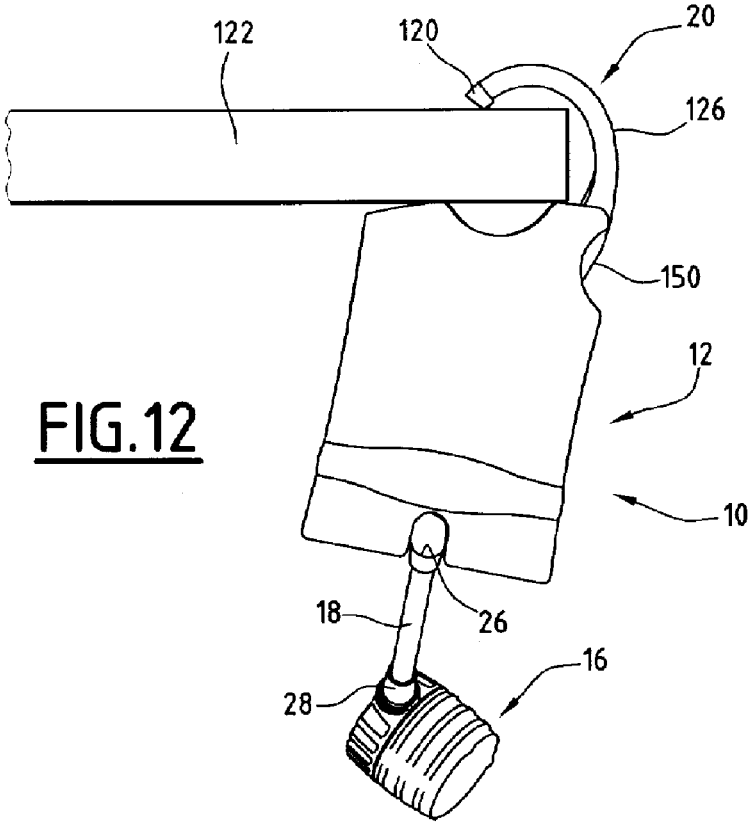
FIG. 12 is a view, in diagrammatic form, of the use of a portable lighting device according to the invention.
Figure 13:
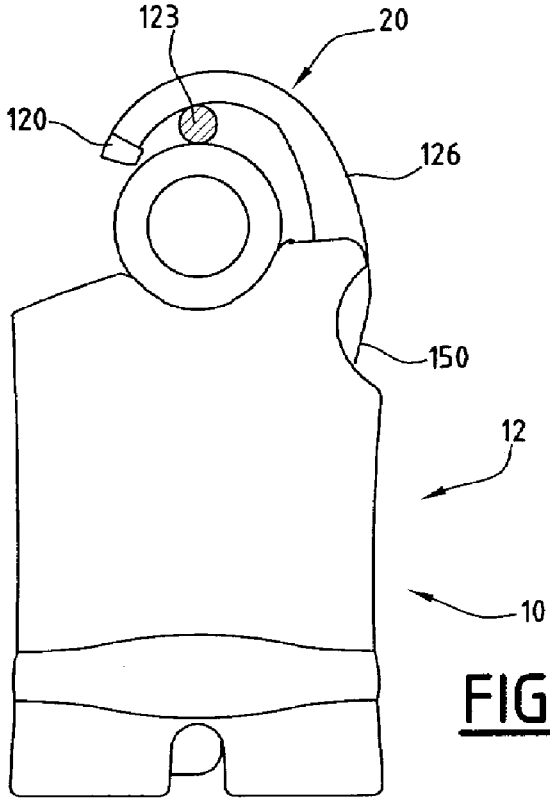
FIG. 13 is a view, in diagrammatic form, of a variant of the use of a portable lighting device according to the invention.

FIGS. 7 and 8 show, in an advantageous manner, the means by which the portable lighting device 10 according to the invention is recharged. The housing 12 has a lower face 98 from which there is accessible, from outside the housing 12, the electrical connection socket 40 for recharging the battery.

A base 100 comprises a recess 102 delimited by a bottom 104 suitable for receiving the lower portion 98 of the housing 12.

A plug 106 of a connector plug 108 passes through an opening 110 provided in the bottom 104 of the base 100. The plug 106 is complementary to the socket 40 and is of the jack type. The connector 108 is advantageously removably mounted on the base 100.

To that end, a lug 112 derived from the base has a generally V-shaped opening 114 which receives a lateral prolongation 116 integral with the connector 108. Accordingly, recharging of the rechargeable battery 34 can be carried out in two different ways. A first method consists in using, as seen hereinbefore, the base 100 equipped with the connector 108 provided with the plug 106. The second method consists in plugging the plug 106 of the connector 108 directly into the socket 40 without using the base 100.

FIGS. 7 to 13 show how the portable lighting device 10 according to the invention is fixed and/or hung.

The housing 12 is equipped with a C-shaped holding member 20 which is integral with the housing 12 and is to hold the lighting head 16 in a fixed position in the immediate vicinity of the housing 12. The holding member 20 is mounted on the housing 12. It is connected thereto by one end and has at its other end a gripping member 120, such as a non-slip pad made of elastomeric material, the gripping member being intended to fixedly engage the supply housing 12 relative to an external support 122 (FIG. 12) when the lighting head 16 is in the second position remote from or not integral with the supply housing 12.

Advantageously, the holding member 20 surrounds the outer periphery 124 of the lighting head 16 at least partially (FIG. 7) and protects it from impacts when the head 16 is in the first position close to or integral with the supply housing 12.

The holding member 20 comprises an element 126 which is movable relative to the housing 12. That element is a hook of curved shape and has one end 128 which is pivotably articulated relative to the supply housing 12 and a free end on which the pad 120 is arranged.

Figure 9:
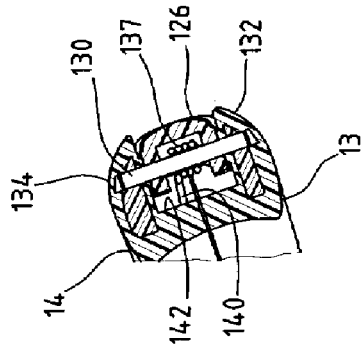
FIG. 9 is a cutaway view according to line IX-IX of FIG. 7.

FIG. 9 shows the transverse cross-section of the hook 126 in the region of the pivot. The hook 126 is mounted in a cap formed by wings 132 and 134 of the shells 13 and 14, respectively, pivotably mounted about a pin 130, the ends of which are embedded in the wings.

A biasing means 136, in the form of a hairpin spring, biases the hook 126 and tends to bring the free end 120 of the hook 126 and the supply housing 12 together. The helical portion 137 of the hairpin spring 136 is wound coaxially on the pin 130 and inside the C shape of the hook 126. The free ends 138 and 140 (FIG. 7) of the hairpin spring 136 rest, respectively, on an inner surface 141 of the hook 126 and on a bottom surface 142 of the cap constituted by the wings 132 and 134.

The pivoting end 128 of the hook 126 is extended beyond the pin 130 by an operating trigger 150 integral with the hook 126. This arrangement facilitates activation of the movement of the hook 126 by application of a force to the trigger 150 according to arrow F shown in FIG. 7 and against the spring 136. Pressure on the trigger 150 tends to introduce the trigger 150 towards the inside of the housing 12 and moves the free end 120 of the hook 126 away from the supply housing 12 so that the hook 126 no longer surrounds the lighting head 16. The lighting head 16 can thus easily be disengaged from the recess 22 in the housing 12 by rotation of the arm 18 about the axis Y-Y.

Because the hook 126 has a curved shape, the concavity of which faces the supply housing, it is possible, by operating the trigger 150, to position a flat external support 122 (FIG. 12) between the hook 126 and the housing 12 and thus hold the housing 12 in a fixed position on the flat support 122 by squeezing, owing to the presence of the spring 136.

It is also possible to use the hook 126 as a hanging element in the conventional manner. To that end, the trigger 150 is operated against the spring 136, and the hook 126 is positioned around an external rod 123 (FIG. 13) of small transverse cross-section. The lighting head 16 is then not necessarily remote from the housing 12, it being possible for the rod to be wedged between the lighting head 16 and the hook 126.

In the description just given, the recess 22 for receiving the lighting head 16 surrounds and protects part of the head from any impacts. However, the recess 22 is not essential for carrying out the invention.

By virtue of the invention, the portable lighting device is versatile in use and is compact. The ratios of weight and dimensions between the various components of the device are such that its stability is improved whatever the use configuration. Moreover, the lighting device according to the invention can be hung in various ways.

The invention claimed is:

1. A portable lighting device, comprising:

a power supply housing;

a lighting head having at least one light source;

a linking arm of elongate shape, said arm having a first end connected to said supply housing and a second end connected to said lighting head so as to mechanically link said supply housing and said lighting head;

wherein said lighting head is movable relative to said supply housing between a first position in which said lighting head is adjacent to said supply housing and at least one second position in which said lighting head is remote from said supply housing;

wherein said arm has a length less than or equal to the largest dimension of said supply housing;

wherein said housing has a generally parallelepipedal shape that defines a stable base for placement on a surface;

wherein the weight distribution between (a) said housing, and (b) said lighting head and said arm, and the size of said arm, are such that the position of the center of gravity of said lighting device remains close to the center of gravity of said housing regardless of the position of said lighting head;

wherein said housing has a transverse cross section that has an oblong shape with a central narrow portion;

wherein said housing further comprises an external groove in an external surface of said housing that extends along a longitudinal axis in a median plane of said housing, said groove accommodating at least part of said arm when said lighting head is in said first position, and said groove being located at said central narrow portion.

2. The portable lighting device of claim 1, wherein said first end of said arm is articulated relative to said housing on a first axis of rotation.

3. The portable lighting device of claim 2, wherein said second end of said arm is articulated relative to said lighting head on a second axis of rotation.

4. The portable lighting device of claim 3, wherein said second axis of rotation is substantially perpendicular to said first axis of rotation.

5. The portable lighting device of claim 1, wherein at least one of said ends of said arm is articulated solely for rotation about an axis of rotation.

6. The portable lighting device of claim 1, wherein said arm is rigid.

7. The portable lighting device of claim 1, wherein said arm is flexible such that said arm can be manually manipulated and can retain a given shape indefinitely.

8. The portable lighting device of claim 1, wherein said housing comprises a recess that accommodates at least part of said lighting head when said lighting head is in said first position.

9. The portable lighting device of claim 1, wherein said housing has a recess that permits rotation of said first end of said arm about said first axis of rotation.

10. The portable lighting device of claim 1, wherein said lighting head comprises a protective cover, a body, an optical element, said optical element being mounted in said lighting head spaced from said light source and in abutment with a support that is integral with said body, and resilient members integral with said cover and in abutment with and supporting said optical element.

11. A portable lighting device, comprising:

a power supply housing;

a lighting head having at least one light source;

a linking arm of elongate shape, said arm having a first end connected to said supply housing and a second end connected to said lighting head so as to mechanically link said supply housing and said lighting head;

wherein said lighting head is movable relative to said supply housing between a first position in which said lighting head is adjacent to said supply housing and at least one second position in which said lighting head is remote from said supply housing;

wherein said arm has a length less than or equal to the largest dimension of said supply housing;

wherein said housing has a generally parallelepipedal shape that defines a stable base for placement on a surface;

wherein the weight distribution between (a) said housing, and (b) said lighting head and said arm, and the size of said arm, are such that the position of the center of gravity of said lighting device remains close to the center of gravity of said housing regardless of the position of said lighting head;

wherein said housing has an elongated shape that defines a length of said housing and a transverse cross section that has an oblong shape with a central narrow portion that extends substantially throughout said length of said housing.

12. The portable lighting device of claim 11, wherein said first end of said arm is articulated relative to said housing on a first axis of rotation.

13. The portable lighting device of claim 12, wherein said second end of said arm is articulated relative to said lighting head on a second axis of rotation.

14. The portable lighting device of claim 13, wherein said second axis of rotation is substantially perpendicular to said first axis of rotation.

15. The portable lighting device of claim 11, wherein at least one of said ends of said arm is articulated solely for rotation about an axis of rotation.

16. The portable lighting device of claim 11, wherein said arm is rigid.

17. The portable lighting device of claim 11, wherein said arm is flexible such that said arm can be manually manipulated and can retain a given shape indefinitely.

18. The portable lighting device of claim 11, wherein said housing comprises a recess that accommodates at least part of said lighting head when said lighting head is in said first position.

19. The portable lighting device of claim 11, wherein said housing has a recess that permits rotation of said first end of said arm about said first axis of rotation.

20. The portable lighting device of claim 11, wherein said lighting head comprises a protective cover, a body, an optical element, said optical element being mounted in said lighting head spaced from said light source and in abutment with a support that is integral with said body, and resilient members integral with said cover and in abutment with and supporting said optical element.

* * * * *